United States Patent [19]

Fitzgerald et al.

[11] Patent Number: 4,922,264

[45] Date of Patent: May 1, 1990

[54] SATELLITE ANTENNA MOUNTING APPARATUS WITH BALLAST MEANS

[76] Inventors: Robert M. Fitzgerald, 3545 Saxon Way, Marietta, Ga. 30062; Eugene O. Gresens, 5266 Westhill Dr., Norcross, Ga. 30071

[21] Appl. No.: 341,846

[22] Filed: Apr. 24, 1989

[51] Int. Cl.[5] ..... H01Q 1/12; E04H 12/18

[52] U.S. Cl. ..... 343/878; 343/890; 248/539; 248/910; 52/294

[58] Field of Search ..... 343/878, 890, 912, 915, 343/40; 52/119, 120, 149, 150, 152, 292, 294; 248/539, 910

[56] References Cited

U.S. PATENT DOCUMENTS

| | | | |
|---|---|---|---|
| 3,415,475 | 12/1968 | Goodman | 248/158 |
| 4,649,675 | 3/1987 | Moldovan et al. | 343/878 |
| 4,723,128 | 2/1988 | Gasque, Jr. | 343/878 |
| 4,799,642 | 1/1989 | Wright | 343/890 |

FOREIGN PATENT DOCUMENTS

| | | | |
|---|---|---|---|
| 0140003 | 8/1982 | Japan | 343/878 |

*Primary Examiner*—Rolf Hille
*Assistant Examiner*—Doris J. Johnson
*Attorney, Agent, or Firm*—Rodgers & Rodgers

[57] ABSTRACT

Antenna mounting apparatus especially for use in connection with satellite dishes comprises a base assembly with an antenna extending upwardly therefrom, multiple ballast means extending radially from the base assembly, outer end plates disposed respectively adjacent the end of the ballast means remote from the base assembly, an aperture formed in each ballast means, and tie rods extending respectively through the apertures and interconnecting the base assembly and the associated outer end plate.

9 Claims, 1 Drawing Sheet

SATELLITE ANTENNA MOUNTING APPARATUS WITH BALLAST MEANS

BACKGROUND OF THE INVENTION

This invention relates to a roof mounting structure for satellite dish antennas. In order to optimize reception and reduce transmission interference from surrounding structures, satellite dish antennas are typically mounted on building roof tops. Because of the large exposed surface areas, antennas are extremely susceptible to undesirable movement or even overturning due to varying wind conditions. In order to stabilize roof mounted antennas, in general, they have been permanently attached to building roof tops by means of attachment assemblies which structurally penetrate the building. Of course, this often causes water leaks and makes it more difficult to move an antenna to another location.

Known satellite antenna mounting assemblies which are nonpenetrating in nature are most often complicated intricate structures which are difficult to assemble. In addition, known nonpenetrating antenna mounting structures are quite cumbersome and heavy requiring substantially increased costs in transporting the unit from the manufacturer to the consumer. An example of a nonpenetrating roof mount antenna structure is disclosed in U.S. Pat. No. 4,649,675.

SUMMARY OF THE INVENTION

By this invention, antenna mounting apparatus is provided and comprises a base assembly, ballast means disposed adjacent the base assembly, an outer end plate disposed adjacent the ballast means remote from the base assembly, and a tie rod extending generally adjacent the ballast means so that stress from the base assembly is transferred to the ballast means.

DESCRIPTION OF THE PREFERRED EMBODIMENT

Figure 1:
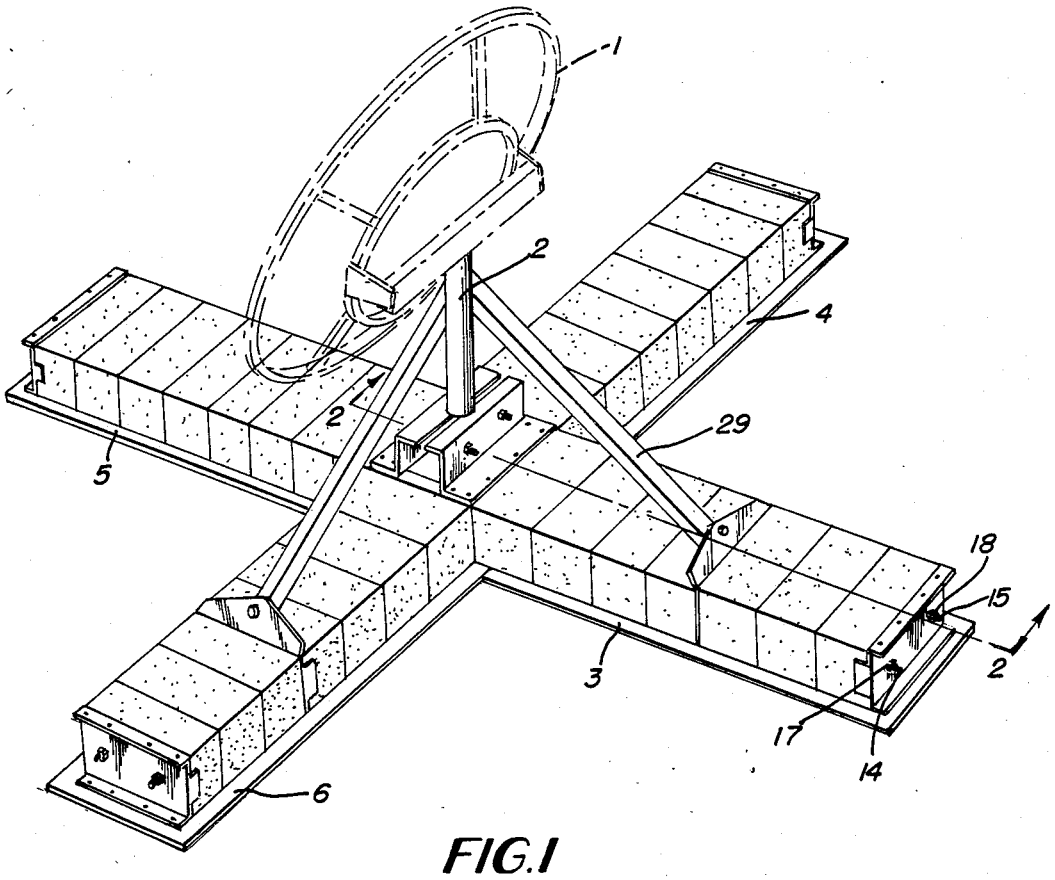
FIG. 1 is a perspective view of the satellite antenna mounting apparatus formed according to this invention.

In the drawing, the numeral 1 designates the satellite dish antenna according to this invention. Antenna 1 is secured atop mast 2 in known fashion. The mounting structure for the satellite dish includes cushion pads 3, 4, 5 and 6. Since the elements associated with each cushion pad 3–6 are essentially identical, only the structure associated with cushion pad 3 will be described in detail, it being understood that four radial units are utilized to form the configuration shown in the FIG. 1. Of course various other configurations could be utilized within the scope of this invention.

In order to increase friction, cushion pad 3 is made of a sheet of neoprene rubber approximately 1/16 inch thick. Overlying cushion pad 3 is the antenna mounting apparatus ballast means in the form of multiple successively abutting concrete blocks 7–13. Concrete blocks 7–13 are of standard construction each having a pair of discrete apertures formed therein with the axes extending substantially perpendicular to mast 2. Of course, other nonstandard concrete blocks could be utilized such as those having three or more apertures. The corresponding apertures of concrete blocks 7–13 are in alignment thereby forming a pair of elongated apertures. Tie rods 14 and 15 extend through these elongated apertures, respectively. Outer end plate 16 is positioned flush against the outer surface of concrete block 13. Tie rods 14 and 15 extend through corresponding apertures in outer end plate 16 and are secured in place, respectively, by means of nuts 17 and 18.

The antenna base assembly formed according to this invention is indicated generally by the numeral 19 and includes mast 2 together with inner end plate 20 which is disposed flush against the inner surface of concrete block 7. Tie rod 15 extends through a corresponding aperture in inner end plate 20 and nut 21 is secured in known fashion to the inner end of tie rod 15. Although not shown in the drawing, identical fastening structure is formed in connection with tie rod 14 and inner end plate 20.

Figure 2:
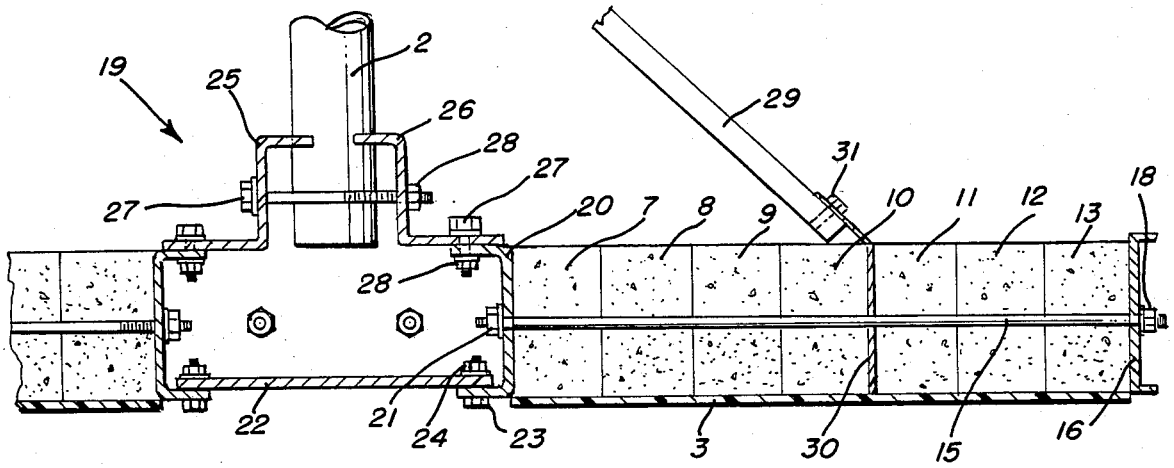
FIG. 2 is a cross sectional view taken along the line 2—2 in FIG. 1.

The antenna base assembly also includes base plate 22 which is secured to inner end plate 20 by means of bolt 23 and nut 24. The left hand end of base plate 22, as viewed in FIG. 2, is secured in the same way as that in connection with inner end plate 20.

In order to maintain mast 2 in a stable position, clamps 25 and 26 are provided. Clamp 26 is secured to the upper portion of inner end plate 20 by means of bolt 27 and nut 28. Clamp 25 is secured in position the same as clamp 26 and as best shown in FIG. 2. Clamps 25 and 26 are maintained in a snug position against mast 2 by means of bolt 27 and nut 28. An identical bolt and nut assembly is positioned on the opposite side of mast 2.

For ease of assembly, bolts 23 and 27 can be pressed into inner end plate 20. Also the number of nut and bolt assemblies can be varied depending on structural requirements.

In order to provide additional stabilizing means for antenna 1, diagonal brace 29 is provided. Diagonal brace 29 is secured, at the upper end thereof, to mast 2 by any means such as welding or other suitable fastening means. Plate 30 is disposed between concrete blocks 10 and 11 with the upper end thereof angled in such manner that it overlaps in face contacting relation the lower portion of diagonal brace 29 and is secured thereto by means of bolt 31. As shown in FIG. 1, multiple diagonal braces may be employed, as desired.

In order to erect the antenna mounting apparatus according to this invention, initially it is necessary to clear the existing loose roofing material away to provide a smooth surface upon which to mount the antenna assembly. Following this operation, cushion pads 3–6 are placed in a general "X" shaped pattern as shown in FIG. 1. Then ballast means in the form of concrete blocks 7–13 is placed on each cushion pad 3–6. Plate 30 can be inserted between concrete blocks 10 and 11, as desired.

Inner end plate 20 is then placed in abutting relationship with the inner surface of concrete block 7 and, similarly, outer end plate 16 is placed in abutting relationship with the outer surface of concrete block 13. Tie rods 14 and 15 are inserted through corresponding apertures in the ballast means and the entire assembly is secured together by means of nuts 18 and 21 in connection with tie rod 15 and similar fasteners in connection with tie rod 14. By this means, outer end plate 16 and inner end plate 20 are secured on tie rod 15 such that a compression force is placed on ballast means 7–13. Base plate 22 is then positioned on bolt 23 and secured in place by means of nut 24, as best shown in FIG. 2.

Following this, clamp 26 is secured on inner end plate 20 by means of nut and bolt assembly 27, 28 and clamp 25 is similarly secured in place. Mast 2 is inserted between clamps 25 and 26. Then nut and bolt assembly 27, 28 together with the nut and bolt assembly positioned on the opposite side of mast 2 are tightened. Finally diagonal brace 29 is attached to plate 30 by means of bolt 31.

This invention is an improvement over known antenna mounting means in that the ballast means acts as an actual structural member of the mounting apparatus rather than mere ballast. Essentially the ballast is an integral part of the overall structure of the antenna and the weight of the ballast and antenna is spread over a large section of the roof by the ballast means which is held together by compression. When the antenna and mast assembly are under stress, such as caused by wind blowing on the antenna, this stress is transferred from the base assembly directly to the ballast means since the ballast means is interrelated with the base assembly by means of the tie rod structure. Normally the ballast does not act as an integral part of the mounting means and serves no purpose other than ballast. Also, the tie rod functions effectively if positioned alongside the concrete blocks rather than extending through the apertures formed therein.

Therefore, by this invention, a light weight and economical mounting apparatus for a satellite antenna is provided since the ballast means is in the form of standard concrete blocks which can be purchased in close proximity to the installation site of the antenna and at the same time serve as an important structural element of the mounting apparatus. Also, in order to conform to varying roof configurations and atmospheric conditions, the configuration of the ballast means can be easily altered with very little modification in the other elements of the mounting apparatus.

I claim:

1. Antenna mounting apparatus comprising a base assembly, said base assembly comprising an inner end plate, ballast means disposed generally adjacent said base assembly and in abutting relationship with said inner end plate, an outer end plate disposed in abutting relationship with said ballast means remote from said base assembly, a tie rod interconnected to said inner and outer end plates and extending generally adjacent said ballast means, and means to secure said end plates on said tie rod so as to place a compression force on said ballast means.

2. Apparatus according to claim 1 wherein an antenna extends upwardly from said base assembly.

3. Apparatus according to claim 1 wherein an aperture is formed in said ballast means.

4. Apparatus according to claim 3 wherein said tie rod extends through said aperture.

5. Apparatus according to claim 1 wherein said ballast means comprises a concrete block.

6. Apparatus according to claim 1 wherein said ballast means comprises multiple concrete blocks.

7. Apparatus according to claim 3 wherein a second aperture is formed in said ballast means and wherein a second tie rod extends through said second aperture and interconnects said base assembly and said outer end plate.

8. Apparatus according to claim 2 wherein a diagonal brace interconnects said antenna and said ballast means.

9. Apparatus according to claim 1 wherein said ballast means overlies a cushion pad.

* * * * *

US004922264B1

REEXAMINATION CERTIFICATE (2736th)

United States Patent [19] [11] B1 4,922,264

Fitzgerald et al. [45] Certificate Issued Nov. 21, 1995

[54] SATELLITE ANTENNA MOUNTING APPARATUS WITH BALLAST MEANS

[76] Inventors: Robert M. Fitzgerald, 3545 Saxon Way, Marietta, Ga. 30062; Eugene O. Gresens, 5266 Westhill Dr., Norcross, Ga. 30071

Reexamination Request:
No. 90/002,952, Dec. 17, 1992

Reexamination Certificate for:

| | |
|---|---|
| Patent No.: | **4,922,264** |
| Issued: | **May 1, 1990** |
| Appl. No.: | **341,846** |
| Filed: | **Apr. 24, 1989** |

[51] Int. Cl.[6] ..... H01Q 1/12; E04H 12/18

[52] U.S. Cl. ..... 343/878; 343/890; 248/539; 248/910; 52/294

[58] Field of Search ..... 343/878, 890, 343/840, 912, 915; 52/40, 119, 120, 149, 150, 152, 292, 294; 248/539, 910

[56] References Cited

U.S. PATENT DOCUMENTS

| | | | |
|---|---|---|---|
| 592,146 | 10/1897 | Kempton | 52/152 |
| 657,867 | 9/1900 | Forsythe | 52/150 |
| 1,134,897 | 4/1915 | Novess | 52/150 |
| 1,271,751 | 7/1918 | Novess | 52/150 |
| 3,415,475 | 12/1968 | Goodman | 248/158 |
| 3,962,088 | 6/1976 | Kuhlenschmidt et al. | 210/170 |
| 4,649,675 | 3/1987 | Moldovan et al. | 343/878 |
| 4,723,128 | 2/1988 | Gasque | 343/878 |
| 4,799,642 | 1/1989 | Wright | 343/890 |

FOREIGN PATENT DOCUMENTS

| | | | |
|---|---|---|---|
| 0140003 | 8/1982 | Japan | 343/878 |

*Primary Examiner*—Michael C. Wimer

[57] ABSTRACT

Antenna mounting apparatus especially for use in connection with satellite dishes comprises a base assembly with an antenna extending upwardly therefrom, multiple ballast means extending radially from the base assembly, outer end plates disposed respectively adjacent the end of the ballast means remote from the base assembly, an aperture formed in each ballast means, and tie rods extending respectively through the apertures and interconnecting the base assembly and the associated outer end plate.

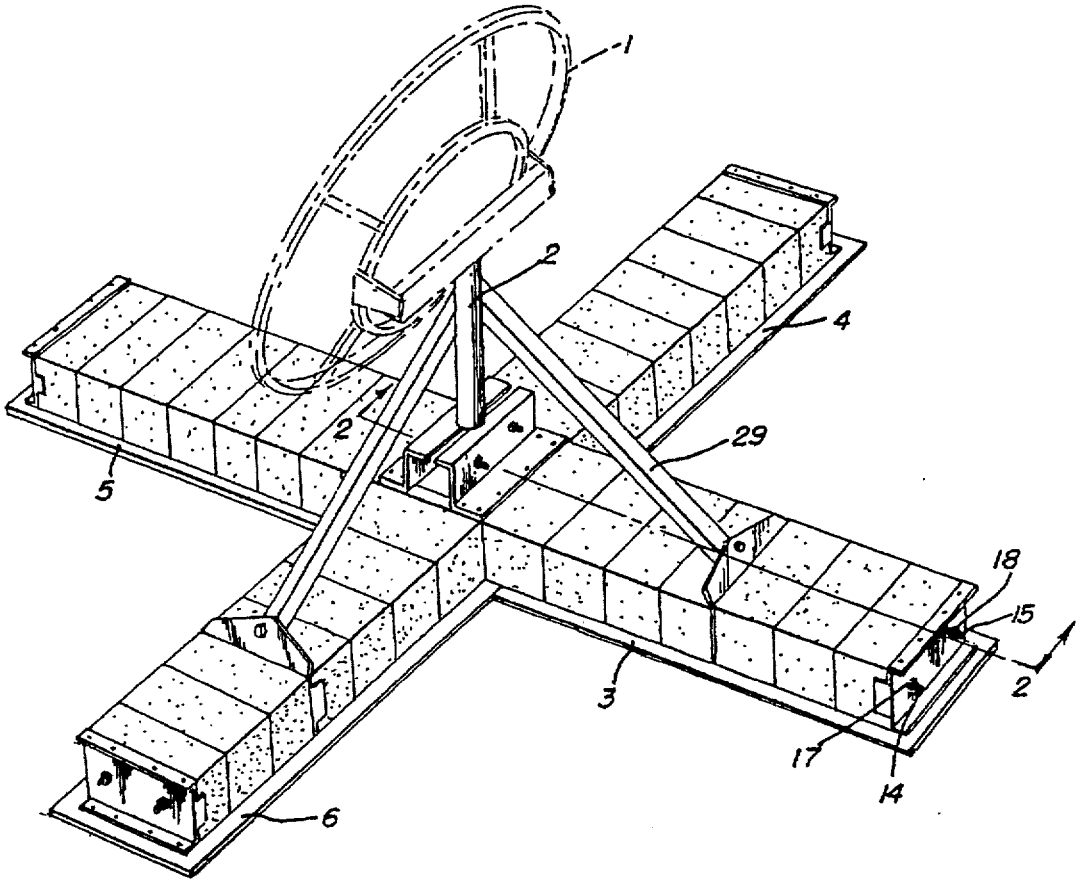

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, line 60 to Column 2, line 10:

In order to increase friction, cushion pad 3 is made of a sheet of neoprene rubber approximately 1/16 inch thick. Overlying cushion pad 3 is a antenna mounting apparatus ballast means *or ballast unit* in the form of multiple successively abutting concrete blocks 7–13. Concrete blocks 7–13 are of standard construction each having a pair of discrete apertures formed therein with the axes extending substantially perpendicular to mast 2. Of course, other nonstandard concrete blocks could be utilized such as those having three or more apertures. The corresponding apertures of concrete blocks 7–13 are in alignment thereby forming a pair of elongated apertures. Tie rods 14 and 15 extend through these elongated apertures, respectively. Outer end plate 16 is positioned flush against the outer surface of concrete block 13. Tie rods 14 and 15 extend through corresponding apertures in outer end plate 16 and are secured in place, respectively, by means of nuts 17 and 18.

Column 2, lines 25–32:

In order to maintain mast 2 in a stable position, clamps 25 and 26 are provided. Clamp 26 is secured to the upper portion of inner end plate 20 by means of bolt 27 and nut 28. Clamp 25 is secured in position the same as clamp 26 and as best shown in FIG. 2. Clamps 25 and 26 are maintained in a snug position against mast 2 by means of bolt 27 and 28. An identical bolt and nut assembly is positioned on the opposite side of mast 2. *As will be understood by reference to the drawing, the clamps 25 and 26 and securing bolts and nuts form a lower support assembly engaging the mast adjacent its lower end in at least three quadrants of a circle around the mast.*

Column 2, lines 37–46:

In order to provide additional stabilizing means for antenna 1, diagonal brace *or upper support member* 29 is provided. Diagonal brace 29 is secured, at the upper end thereof, to mast 2 by any means such as welding or other suitable fastening means. Plate 30 is disposed between concrete blocks 10 and 11 with the upper end thereof angled in such manner that it overlaps in face contacting relation the lower portion of diagonal brace 29 and is secured thereto by means of bolts 31. As shown in FIG. 1, multiple diagonal braces may be employed, as desired.

AS A RESULT OF REEXAMINATION, IT HAS BEEN DETERMINED THAT:

Claims 1–9 are cancelled.

* * * * *